US006183221B1

(12) United States Patent
Hsieh

(10) Patent No.: US 6,183,221 B1
(45) Date of Patent: Feb. 6, 2001

(54) HEAT DISSIPATION FAN WITH A SHAFT POSITIONED TO PREVENT CHAFING BETWEEN THE FAN BLADES AND THE BEARING

(76) Inventor: Hsin-Mao Hsieh, No. 6, East Section, Chiao Nan Li, Industrial 6th Rd., Pingtung City, Pingtung Hsien (TW)

( * ) Notice: Under 35 U.S.C. 154(b), the term of this patent shall be extended for 0 days.

(21) Appl. No.: 09/430,375

(22) Filed: Oct. 29, 1999

(51) Int. Cl.[7] ..... F04B 17/03

(52) U.S. Cl. ..... 417/423.12; 415/220; 415/171.1; 416/204 R

(58) Field of Search ..... 417/423.12; 415/220, 415/229, 171.1, 174.2; 416/204 R

(56) References Cited

U.S. PATENT DOCUMENTS 3,378,192 * 4/1968 Friese ..... 417/423.12
3,786,290 * 1/1974 Papst et al. ..... 310/90
4,128,364 * 12/1978 Papst et al. ..... 417/354
4,564,335 * 1/1986 Harmsen et al. ..... 415/218.1
4,783,608 * 11/1988 Gruber et al. ..... 310/90
4,801,252 * 1/1989 Wrobel ..... 417/354
4,955,791 * 9/1990 Wrobel ..... 417/354
6,000,919 * 12/1999 Hsieh ..... 417/423.15

* cited by examiner

*Primary Examiner*—Timothy S. Thorpe
*Assistant Examiner*—Robert Z. Evora
(74) *Attorney, Agent, or Firm*—Kolisch Hartwell Dickinson McCormack & Heuser

(57) ABSTRACT

A heat dissipation fan as disclosed includes a heat dissipation fan blade, a self-lubricating bearing, a stator having an electrical circuit plate and a casing. The heat dissipation fan blade includes a shaft extending therefrom. The shaft has a rounded free end that and contains a neck to seat a locking plate therein. The casing has a collar extending therefrom to hold the stator in place. The collar contains a recess to securely receive the self-lubricating bearing and forms an internal shoulder to restrain and support the locking plate and the self-lubricating bearing. The locking plate is round and contains a through hole therein. The through hole has a diameter corresponding to that of the neck in the shaft. The locking plate has multiple slits formed on the periphery of the through hole. A washer is placed in the bottom of the recess and contains a hole with a diameter smaller than the shaft to abut the free end of the shaft.

1 Claim, 5 Drawing Sheets

HEAT DISSIPATION FAN WITH A SHAFT POSITIONED TO PREVENT CHAFING BETWEEN THE FAN BLADES AND THE BEARING

BACKGROUND OF THE INVENTION

1. Field of the Invention

The present invention relates to a heat dissipation fan, and more particularly to a small direct current heat dissipation fan having a locking plate.

2. Description of Related Art

A conventional heat dissipation fan in accordance with the prior art shown in FIG. 4 and FIG. 5 comprises a heat dissipation fan blade (60), a bearing (61), a stator (63) with a circuit board (62) and a casing (64). The heat dissipation fan blade (60) has an shaft (601) extending therefrom. The shaft (601) has a free end that is cone-shaped and contains a groove (602) to receive a locking ring (50). The casing (64) includes a collar (641) to hold the stator (63) in place, and the collar (641) contains a recess (642) to receive the bearing (61). The recess (642) has a through hole (643) to allow the shaft (601) to extend through. The locking ring (50) contains a hole (51) that has a diameter corresponding with that of the groove (602). The locking ring (50) further contains a slit (52) extending out from the hole (51).

To assemble the heat dissipation fan, the stator (63) and the circuit board (62) are placed around the collar (641) of the casing (64), and the bearing (61) is pressed into the recess (642) of the collar (641). The shaft (601) of the heat dissipation fan blade (60) is locked into the bearing (61) by the locking ring (50) that is clipped into the groove (602) after the shaft extends through the bearing (61) and the through hole (643) of the recess (642).

A worker needs a tool to press the locking ring (50) into the groove (602) of the shaft (601) when assembling the heat dissipation fan. Since the locking ring (50) has only one slit (52), the slit (52) will be opened widely when pressed over the free end of the shaft (601). This heat dissipation fan is a small device with small parts, and the locking ring (50) must be mounted deep in the collar (641) of the casing (64). Consequently, a worker needs to use a special tool to press the locking ring (50) into the groove (602) of the shaft (601). It will be tedious for the worker and reduce output efficiency.

The groove (602) in the shaft (601) extends below the through hole (643) of the recess (642). Therefore, the blade (60) easily falls down and abuts the top portion of the bearing (61). This will cause improper chafing between the blade (60) and bearing (61). The chafing will damage the blade (60) and bearing (61) and further reduce the life of the heat dissipation fan.

The present invention has arisen to mitigate and/or obviate the disadvantage of the conventional

SUMMARY OF THE INVENTION

In accordance with one aspect of the present invention, a heat dissipation fan with a locking member is provided. The locking member includes a locking plate containing a through hole and multiple slits around the through hole. The slits in the locking plate make the assembly of the heat dissipation fan easier and simplifies the assembly thereby saving time and improving the efficiency. Not only does this improve the rate of assembly and increase the output, but it also prevents the shaft of the heat dissipation fan and the bearing from chafing thereby increasing the life of the fan.

Further benefits and advantages of the present invention will become apparent after a careful reading of the detailed description with appropriate reference to the accompanying drawings.

DETAILED DESCRIPTION OF THE INVENTION

Figure 1:
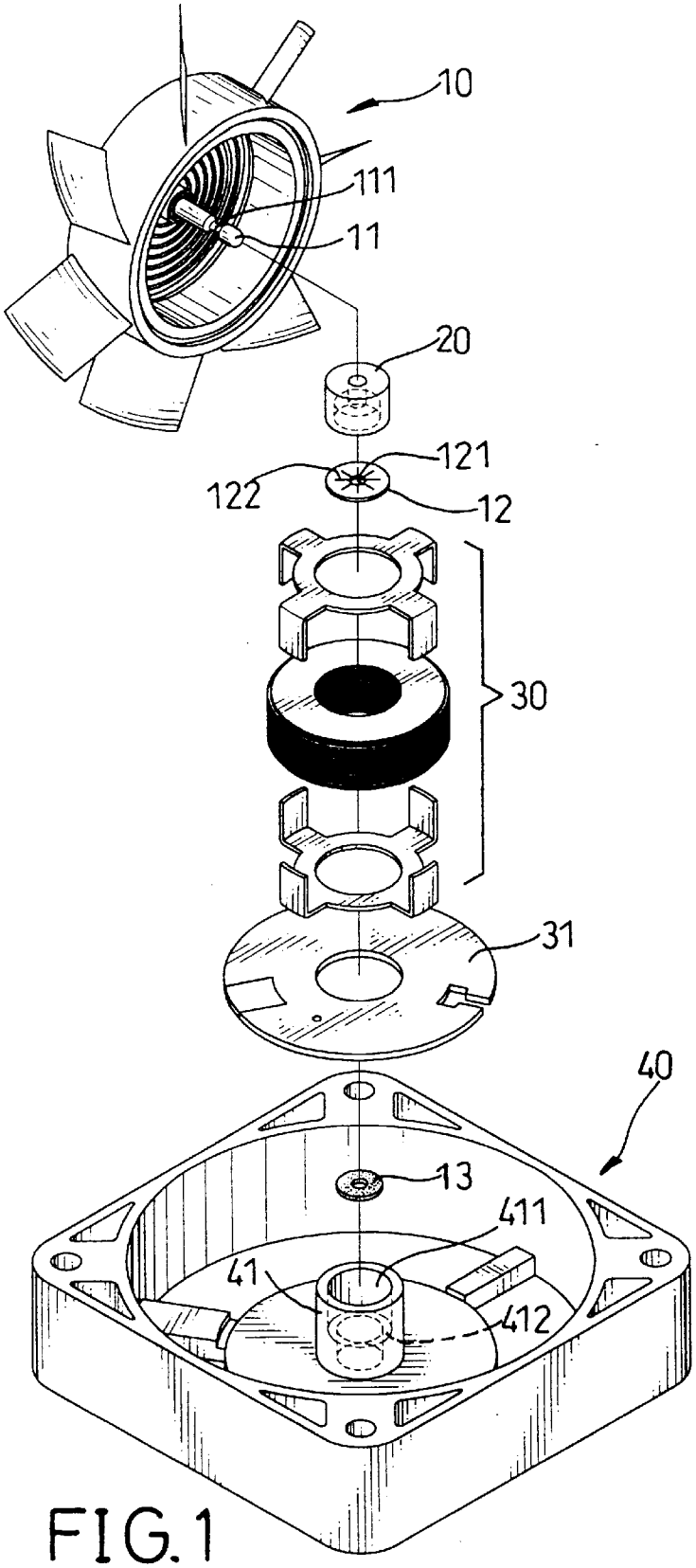
FIG. 1 is an exploded perspective view of a heat dissipation fan in accordance with the present invention.
Figure 2:
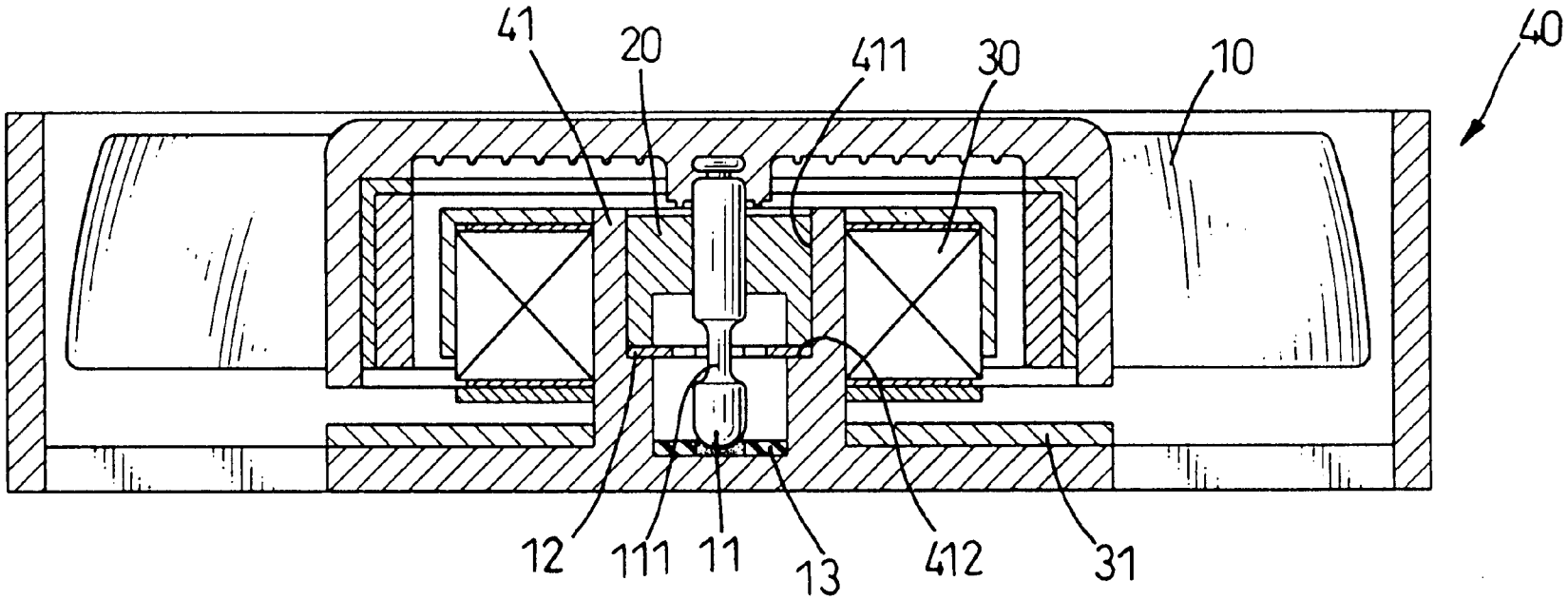
FIG. 2 is a side plan view in partial section of the heat dissipation fan in FIG. 1.
Figure 3:
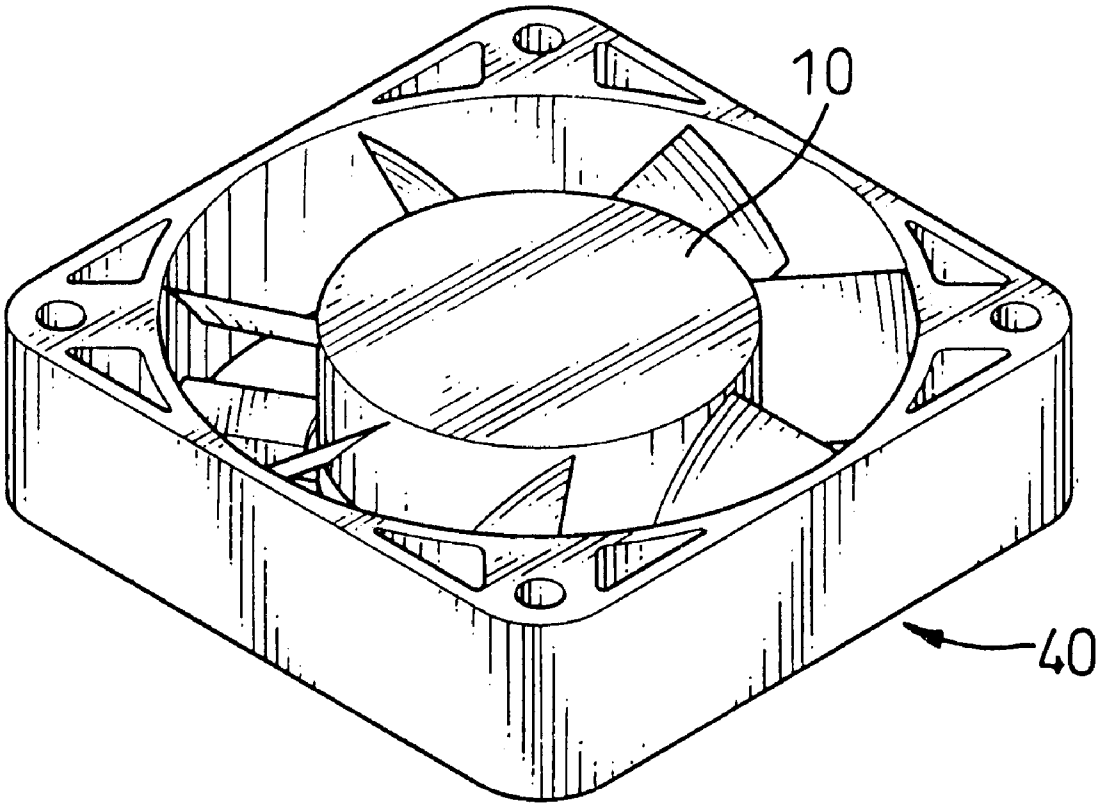
FIG. 3 is a perspective view of the heat dissipation fan in FIG. 1.
Figure 4:
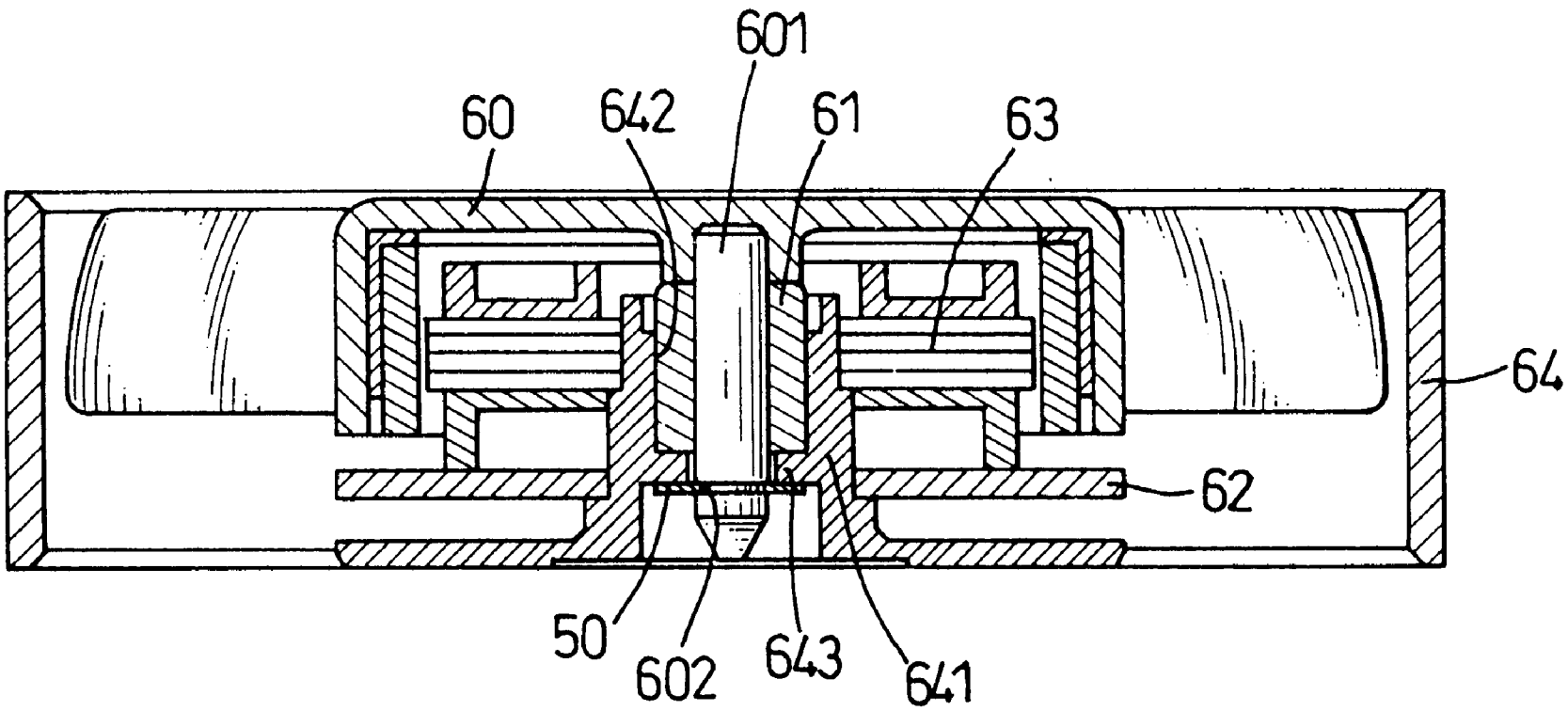
FIG.4 PRIOR ART
FIG. 4 is a side plan view in partial section of a conventional heat dissipation fan in accordance with the prior art.
Figure 5:
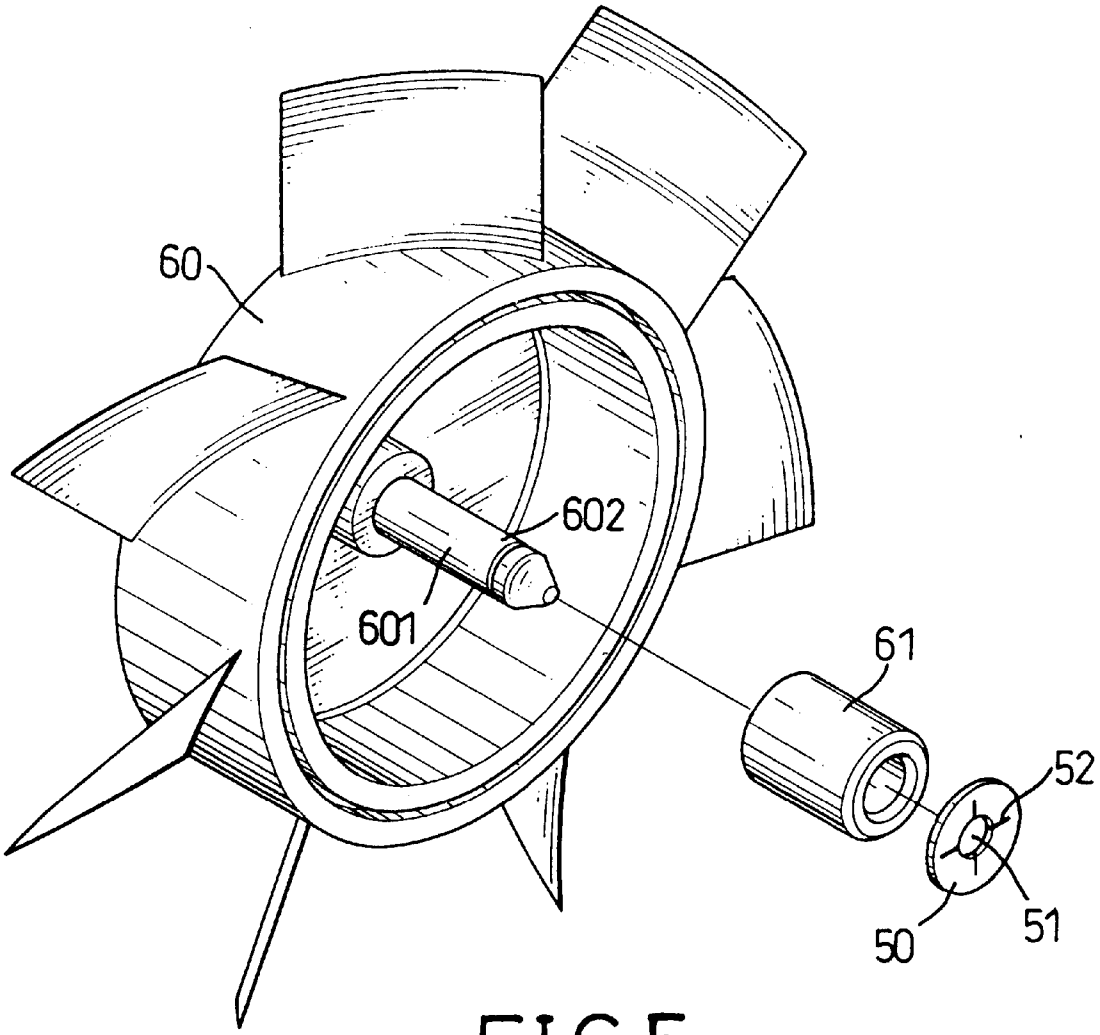
FIG.5 PRIOR ART
FIG. 5 is a partial exploded perspective view of the conventional heat dissipation fan in FIG. 4.

Referring to the drawings and initially to FIG. 1 and FIG. 2, the heat dissipation fan in accordance with the present invention comprises a fan blade (10), a self-lubricating bearing (20), a stator (30) mounted on an electrical circuit plate (31) in a casing (40). The fan blade (10) includes a shaft (11) extending therefrom. The shaft (11) has a free end that is rounded and contains a neck (111) to receiving a locking plate (12). The casing (40) has a collar (41) extending therefrom to hold the stator (30) in place. The collar (41) contains a recess (411) to securely hold the self-lubricating bearing (20) and has an internal shoulder (412) formed therein to support and restrain the locking plate (12) and the self-lubricating bearing (20). The locking plate (12) is round and contains a through hole (121) therein. The through hole (121) has a diameter corresponding with that of the neck (111) in the shaft (11). The locking plate (12) has multiple slits (122) formed on the periphery of the through hole (121). A washer (13) is received in the bottom of the recess (411) and contains a hole with a diameter smaller than the shaft (11) therein to abut the free end of the shaft (11).

To assemble the heat dissipation fan, the stator (30) and the electrical plate (31) are put around the collar (41) of the casing (40). The washer (13) is put in the bottom of the recess (411) first, the locking plate (12) is put on the internal shoulder (412) and the self-lubricating bearing (20) is securely pressed into the recess (411) and abuts the locking plate (12). The shaft (11) of the heat dissipation fan blade (10) is inserted through the self-lubricating bearing (20) and the locking plate (12), and the end of the shaft (11) is pressed through the locking plate (12) until the locking plate (12) is seated in the neck (111). This completes the assembly of the heat dissipation fan.

As mentioned above, the heat dissipation fan in accordance with the present invention has several advantages.

1. Easy to assemble. Since no special tools are required to press the fan blade (10) shaft (11) through the locking plate (12), the assembly of the heat dissipation fan is greatly simplified with a resultant improvement in productivity and efficiency.

2. Prevent improper chafing. The combination of the internal shoulder (412) in the collar (41) and the washer (13) working in conjunction with the end of the heat dissipation fan blade (10) shaft (11) and the bearing (20) virtually obviates any chafing between the heat dissipation fan blade (10) and the bearing (20).

Although the invention has been explained in relation to its preferred embodiment, it is to be understood that many other possible modifications and variations can be made without departing from the spirit and scope of the invention as hereinafter claimed.

What is claimed is:

1. A heat dissipation fan with a shaft positioned to prevent chafing between the fan blade and the bearing comprising:

a fan blade including a shaft extending therefrom, said shaft having a neck formed near the free end thereof;

a self-lubricating bearing containing a hole therein to allow said shaft of said fan blade to penetrate therethrough;

a locking plate seated in said neck of said shaft after penetrating said hole of said self-lubricating bearing and containing a through-hole and multiple slits to communicate with said through-hole;

a casing having a collar extending therefrom, said collar containing a recess securely to receive said self-lubricating bearing therein and an internal shoulder in said recess to support said locking plate and said self-lubricating bearing, said recess having a bottom portion and a washer received in said bottom portion of said recess and abutting said free end of said shaft, said washer positioned to prevent chafing between said fan blade and said self-lubricating bearing; and a stator with an electrical circuit plate around said collar of said casing.

* * * * *